United States Patent [19]

Ross

[11] 4,188,990

[45] Feb. 19, 1980

[54] BOWLING BALL CARRIER INSERT

[76] Inventor: Josef A. Ross, 24 Sergent Ct., Bergenfield, N.J. 07621

[21] Appl. No.: 885,779

[22] Filed: Mar. 13, 1978

[51] Int. Cl.[2] ..... A45C 11/00

[52] U.S. Cl. ..... 150/52 A; 190/51; 206/315 B

[58] Field of Search ..... 190/51, 52; 150/52 A; 206/315 B; 211/14

[56] References Cited

U.S. PATENT DOCUMENTS

| | | | |
|---|---|---|---|
| 2,922,453 | 1/1960 | Le Goff | 150/52 A |
| 3,029,855 | 4/1962 | Telford | 150/52 A |
| 3,521,690 | 7/1970 | Davis | 150/52 A |
| 3,730,241 | 5/1973 | Richardson | 150/52 A |

*Primary Examiner*—Donald F. Norton
*Attorney, Agent, or Firm*—Kenneth S. Goldfarb

[57] ABSTRACT

A bowling ball carrier insert for use with an article of luggage comprising a housing, which is open at the front and provided with opposite side walls, an integral bottom, and a hinged top. Retainer means are mounted on the bottom and carried by the top for securely holding the bowling ball in place. A plurality of open top compartments, the upper of which are closed by the top, are integrally molded as part of the housing. The side walls are trapszoidal in shape for facilitating insertion in an article of luggage.

5 Claims, 6 Drawing Figures

BOWLING BALL CARRIER INSERT

BACKGROUND OF THE INVENTION

FIELD OF THE INVENTION

This invention relates to sporting goods, and more particularly to a bowling ball carrier.

STATE OF THE PRIOR ART

In the past, bowling ball carriers have been especially devised to facilitate the carrying of bowling balls from home to the bowling alley and return and for conveniently and safely storing the bowling ball and bowling shoes when not in use. These bowling ball carriers support and maintain the bowling ball in a secure and convenient manner and usually provide additional space for shoes and a minimum amount of other necessary gear. However, because of the built-in supporting means provided for the bowling ball, the bowling ball carrier is not readily usable as an article of luggage and is inconvenient for any other use. The present invention overcomes these disadvantages by providing a bowling ball insert which not only is capable of being utilized with existing types of luggage, but provides means for facilitating the storage and secure support of the bowling ball and other gear while the article of luggage may be used for other purposes, if desired.

SUMMARY OF THE INVENTION

It is therefore the primary object of the present invention to provide an easily molded bowling ball carrier insert capable of being placed into various types of existing manufactured articles of luggage, yet which will hold and support the bowling ball and allied gear even outside of the article of luggage leaving the article of luggage available when desired for other uses. The concept of the present invention provides for an open front housing having a hinged top, spaced side walls, and a bottom, the top and bottom interconnecting the side walls and provided with compartments at the junctions of the side walls, top and bottom, with the top being hinged to the housing at the rear wall and the top and bottom being provided with retaining means for the bowling ball. The side walls are trapezoidal in shape making the top narrower than the bottom and facilitating the insertion of the bowling ball carrier insert in the article of luggage.

Other ancillary objects and features of the invention will become apparent as the following description proceeds and are attained by this bowling ball carrier insert, a preferred embodiment of which is illustrated, by way of example, in the accompanying drawings.

DETAILED DESCRIPTION OF THE INVENTION

Figure 1:
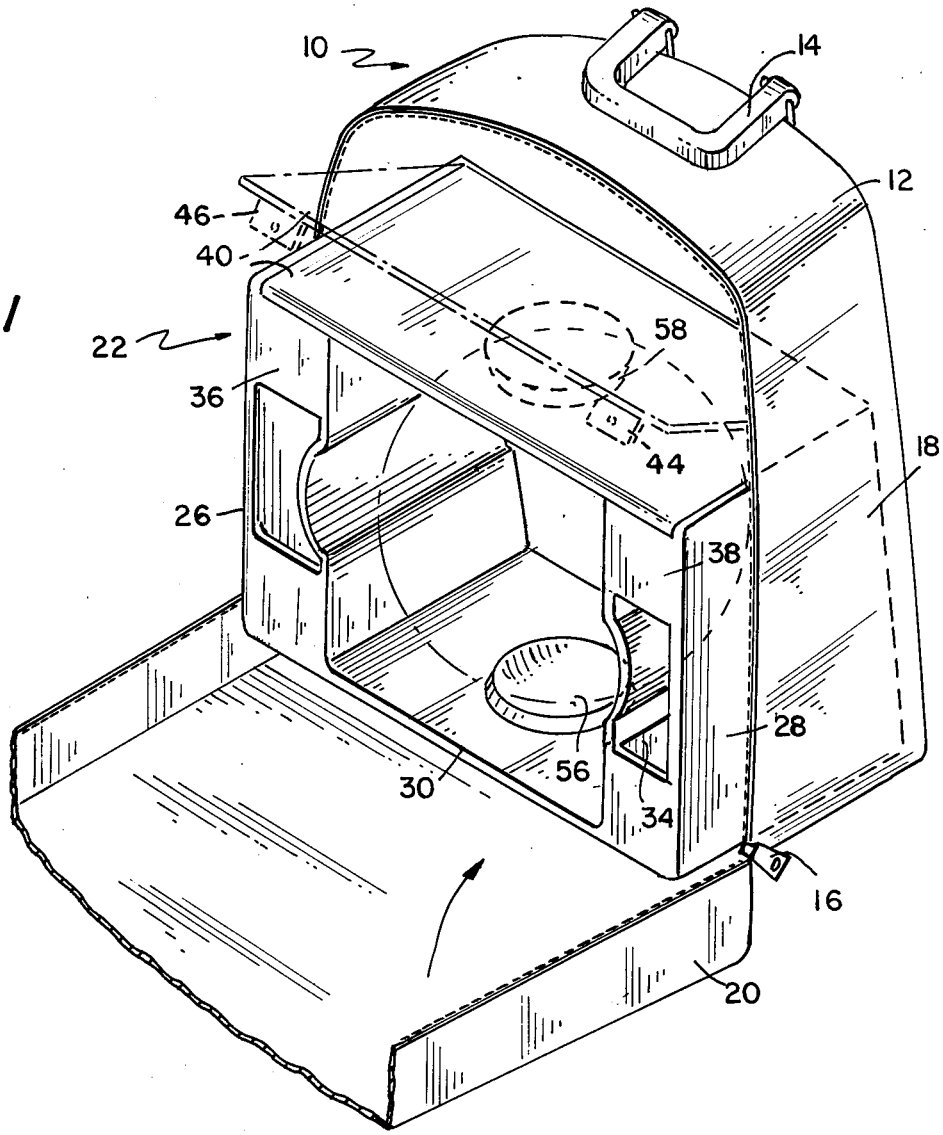
FIG. 1 is a perspective view illustrating the manner in which the bowling ball insert is fitted into an article of luggage.
Figure 2:
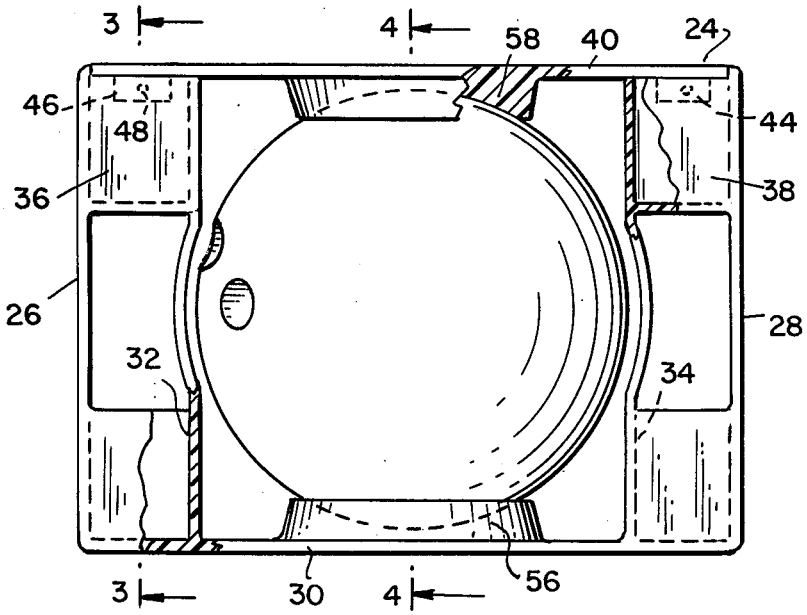
FIG. 2 is an elevational view with parts being broken away showing other parts in section of the bowling ball carrier insert.

With continuing reference to the accompanying drawings, wherein like reference numerals designate similar parts throughout the various views, reference numeral 10 is used to generally designate an article of luggage, which, in accordance with the general construction of one form of luggage, is provided with canvas walls 12 contoured in any desired manner though generally of a trapezoidal shape and provided with handles 14 on each half section. The half sections may be secured to each other by a slide fastener as at 16, one half section 18 being the mirror image of the other half section 20. The bowling ball carrier insert comprising the major element of the present invention, and generally indicated at 22, comprises a generally rectangular shaped housing 24 provided with trapezoidal shaped side walls 26 and 28 and an integrally molded interconnecting bottom 30 and a rear wall 31 which may be provided with an opening 33 for accommodating a bowling ball. The housing 24 is preferably made of a suitably molded plastic and at the junctions of the side walls 26 and 28 and the bottom 30 two compartments 32 and 34, which are open at the top, are integrally molded therewith.

Other compartments 36 and 38, also open at the top, are integrally molded or secured at the upper edges of the side walls and adapted to be overlaid by the top 40, which is hingedly secured as at 42 and 44 to the rear wall 31 of the housing 22. The top 40 is narrower than the bottom 30, therefore facilitating the insertion of the bowling ball carrier insert 22 into the article of luggage 10.

Figure 3:
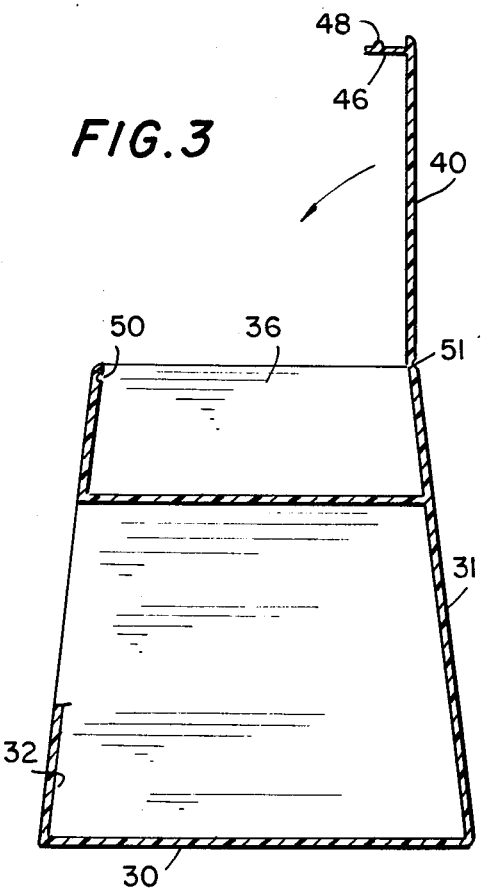
FIG. 3 is a vertical sectional view taken along the plane of line 3—3 in FIG. 2.
Figure 3A:
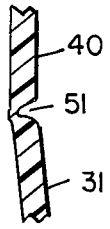
FIG. 3A is an enlarged sectional detail view.
Figure 4:
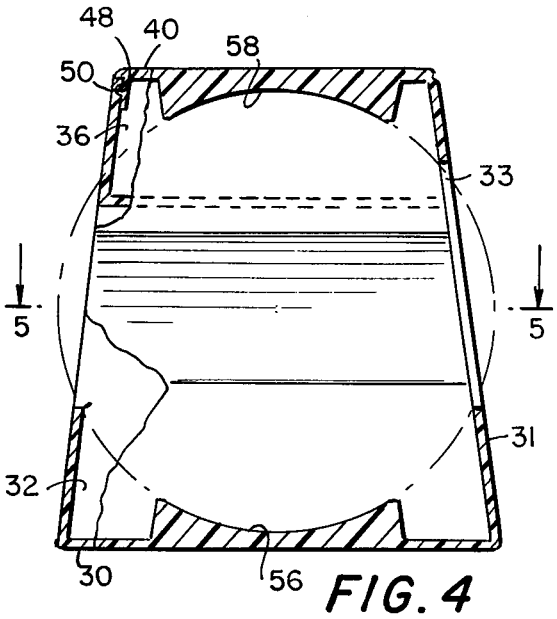
FIG. 4 is a vertical sectional view taken along the plane of line 4—4 in FIG. 2; and, FIG. 5 is a horizontal sectional view taken along the plane of line 5—5 in FIG. 4.
Figure 5:
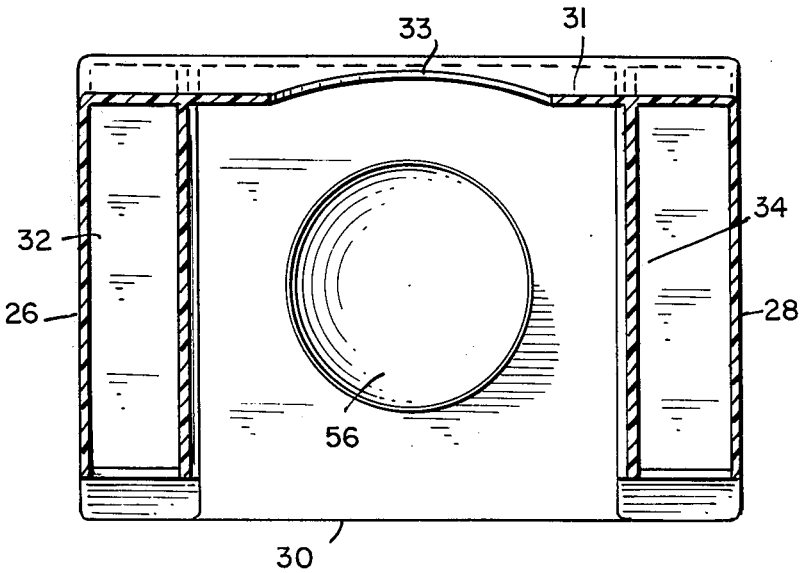

The top 40 is provided with a pair of detents 46, each having a catch 48 for engaging within recesses 50, see FIG. 3A, integrally molded in the compartments 36 and 38.

Fixed to the bottom is a dish-shaped retainer 56 for receiving the bowling ball and the top carries a similar dish-shaped concave retainer 58 for securely engaging and holding the bowling ball in position. The bowling ball is inserted into the insert with the top open. The bowling ball seats in the retainer 56 and extends into opening 33. When the top 40 is closed, the retainer 58 will clampingly engage the bowling ball holding it securely.

Various modifications of this bowling ball carrier insert may be resorted to within the scope of the appended claims.

What is claimed is:

1. A bowling ball carrier insert for use with an article of luggage comprising a housing having opposite side walls interconnected by a top and a bottom, retaining means secured to said top and said bottom, and upper and lower article-receiving compartments at the junctures of said top and said bottom with said side walls.

2. A bowling ball carrier insert according to claim 1, wherein said side walls are trapezoidal in shape.

3. A bowling ball carrier insert according to claim 1, wherein said housing is open at the front, said compartments being open at the top, said side walls being trapezoidal in shape.

4. A bowling ball carrier insert according to claim 3, wherein said top is hingedly secured to said housing closing said upper compartments.

5. A bowling ball carrier insert according to claim 4, wherein said retaining means comprise concave dish-shaped wells.

* * * * *